US006740024B2

(12) United States Patent
Kitai et al.

(10) Patent No.: US 6,740,024 B2
(45) Date of Patent: May 25, 2004

(54) JAW CYLINDER DEVICE AT THE FOLDING STATION OF A WEB-FED PRINTING PRESS

(75) Inventors: Mitsuo Kitai, Kanagawa (JP); Takashi Iijima, Kanagawa (JP); Toshio Hasegawa, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/360,721

(22) Filed: Feb. 10, 2003

(65) Prior Publication Data

US 2003/0211926 A1 Nov. 13, 2003

(30) Foreign Application Priority Data

May 9, 2002 (JP) ..... 2002-134482

(51) Int. Cl.[7] ..... B31F 1/08

(52) U.S. Cl. ..... 493/428; 493/356; 493/360; 493/424; 493/442; 493/454

(58) Field of Search ..... 493/356, 359, 493/360, 424, 426, 434, 436, 439, 442, 444, 454; 270/6, 13, 19, 20.1, 21.1, 47, 48

(56) References Cited

U.S. PATENT DOCUMENTS 3,820,774 A * 6/1974 Hertrich ..... 493/471
5,065,993 A * 11/1991 Reponty ..... 270/49
5,072,919 A * 12/1991 Schneider et al. ..... 270/49
5,201,701 A * 4/1993 Roettger et al. ..... 493/425
5,259,604 A * 11/1993 Schneider et al. ..... 270/47
5,921,906 A * 7/1999 Nagano ..... 493/353
6,234,947 B1 * 5/2001 Michalik ..... 493/425
6,322,487 B1 * 11/2001 Dufour ..... 493/424
6,659,931 B2 * 12/2003 Uera et al. ..... 493/432
6,673,004 B2 * 1/2004 Nanba et al. ..... 493/428

FOREIGN PATENT DOCUMENTS

JP 54-063904 A1 5/1979
JP 60-193365 A1 12/1985

* cited by examiner

*Primary Examiner*—Stephen F. Gerrity
*Assistant Examiner*—Hemant M Desai
(74) *Attorney, Agent, or Firm*—Rader, Fishman & Grauer PLLC

(57) ABSTRACT

The folding station of a rotary printing press has a folding cylinder on which the printed paper web is cut into sections. Mounted opposite the folding cylinder, a jaw cylinder has cut in its surface several jaw cavities each extending parallel to the jaw cylinder axis for receiving the midpart of the web section as the same is inserted therein by a folding blade on the folding cylinder. Each jaw cavity has mounted therein a series of fixed jaw parts and a series of movable jaw parts, the latter being jointly movable toward and away from the former for engaging and folding the midpart of the web section. The two outmost ones of the movable jaw parts are positioned closer to the fixed jaw parts than are the other, medial movable jaw parts, in order to more firmly engage the margins of the web section without causing ink offset between the contacting surfaces of the image areas of the web section.

9 Claims, 5 Drawing Sheets

JAW CYLINDER DEVICE AT THE FOLDING STATION OF A WEB-FED PRINTING PRESS

BACKGROUND OF THE INVENTION

1. Field of the Invention

This invention relates to printing presses, and more particularly to web-fed printing presses having a folding station appended thereto for cutting the printed paper web into sections and folding the successive web sections in the middle into the form of signatures. Still more particularly, the invention deals with a jaw cylinder at the folding station, the jaw cylinder having sets of fixed and movable jaws arranged at circumferential spacings thereon for folding the web sections as they are thrust into the creasing jaw cavities by folding blades on a folding cylinder which also is provided at the folding station.

2. Description of the Prior Art

The folding station of a web-fed printing press usually has a cutter cylinder in addition to the noted folding cylinder and jaw cylinder. All these cylinders are in constant rotation during the progress of printing. The printed web of paper is first wrapped around part of the folding cylinder and, while being done so, cut into successive sections by cutting blades on the cutter cylinder which is held against the folding cylinder via the web. The folding cylinder is equipped with elongate folding blades each extending parallel to the folding cylinder axis and arranged at circumferential spacings thereon. Each folding blade is movable radially of the folding cylinder.

Pushed off the surface of the folding cylinder by one of the folding blades, each web section has its midpart inserted in one of the elongate jaw cavities which are cut in the surface of the jaw cylinder at circumferential spacings. The midpart of the web section that has been pushed into the jaw cavity is therein engaged, together with the folding blade, between the fixed and the movable jaw as the movable jaw is closed against the fixed jaw, and thereby folded along the centerline of the web section. The web section is subsequently carried away from the surface of the folding cylinder by the jaw cylinder as these cylinders rotate in opposite directions. The folding blade withdraws from between the fixed and movable jaws just before the web section is folded, usually behaving, in so doing, as if prying open the jaws.

Difficulties have been experienced in folding the web sections between the fixed and movable jaws because they are not necessarily of the same thickness. In practice, two or more printed webs may be superposed one upon another before being cut into sections. The movable jaws were therefore sprung heavily toward the fixed jaws to engage the web sections of variable thickness against the risk of accidental disengagement and to fill up the spaces created upon withdrawal of the folding blades.

The hard springing of the movable jaws is objectionable, however, because the folding blades behave as aforesaid as if prying open the jaws when withdrawing therefrom. Rubbed by the folding blades withdrawing from between the jaws against the forces of the heavy springs, the web sections were easy to be smeared by ink offset between their contacting surfaces, to the serious degradation of the quality of the printings.

Suggestions were made to prevent ink offset between the contacting surfaces of the web sections. Japanese Unexamined Patent Publication No. 54-63904 teaches the provision of strips of elastomer or like material on the movable jaws for elastically pressing the web sections against the fixed jaws. According to Japanese Unexamined Utility Publication No. 60-193365, on the other hand, spring-loaded pins are slidably mounted to the movable jaws. Each folding blade is recessed in places to permit the spring-loaded pins to engage and press the whole web section against the fixed jaw.

An evaluation of these prior art contrivances demands a brief study of dynamics involved in folding web sections by the cooperation of folding cylinder and jaw cylinder. Riding on the jaw cylinder after having its midpart caught between one pair of fixed and movable jaws, each web section is subjected to centrifugal forces proportional to the square of the angular velocity of the jaw cylinder, the diameter of the jaw cylinder, and the mass of the web section itself. Furthermore, when the web section is pulled off the folding cylinder after having its midpart captured by the jaws, the leading half of the web section must travel in sliding engagement with the folding cylinder, thereby to be subjected to an inertial force tending to pull the web section out of engagement with the jaws.

The current trends in rotary printing presses, particularly those for newspaper production, are toward higher printing speeds and more webs placed one upon another before being jointly cut and folded into signatures. The web sections that have been caught by the creasing jaws on the jaw cylinder are being subjected to more and more centrifugal and inertial forces. The web sections must be gripped so firmly as to prevent accidental disengagement in the face of such ever-increasing centrifugal and inertial forces. However, too strong gripping of the web sections is undesirable because of the greater risk of ink transfer between their contacting surfaces.

Let us now reconsider the prior art devices cited above. An objection to Japanese Unexamined Patent Publication No. 54-63904 is that the elastic strips on the movable jaws press the web sections too hard against the fixed jaws because of the greater force urging the movable jaws toward the fixed jaws, often causing ink offset at these parts of the web sections. Ink offset was even easier to occur at the spring-loaded pins taught by Japanese Unexamined Utility Model Publication No. 60-193365.

SUMMARY OF THE INVENTION

The present invention seeks, in connection with the folding station of a rotary printing press, to engage and fold web sections between fixed and movable jaws on a jaw cylinder so firmly as to preclude accidental disengagement in the face of substantive centrifugal and inertial forces exerted thereon, but with little or no likelihood of ink transfer between the contacting surfaces of the web sections.

Briefly stated in its perhaps broadest aspect, the present invention concerns, in a folding station of a web-fed printing press where a printed paper web is cut into sections by a cutter cylinder while traveling on a folding cylinder, a jaw cylinder for folding each web section into the form of a signature in cooperation with the folding cylinder. The jaw cylinder has cut in its surface one or more jaw cavities each extending parallel to the jaw cylinder axis and all arranged at constant circumferential spacings. Each jaw cavity has mounted therein a movable jaw movable toward and away from a fixed jaw in order to engage and fold each web section as its midpart is inserted in the jaw cavity by a folding blade on the folding cylinder. A less spacing exists between those parts of the fixed and the movable jaw which are to engage the pair of margins on both sides of the image area of each web section than between those parts of the fixed and the movable jaw which are to engage the image area.

It is thus seen that each web section is prevented from accidental disengagement from the jaws by having its pair of margins, possibly together with some neighboring parts of the image area, caught tightly between the fixed and the movable jaw. The image area is not engaged so tightly but pressurized only to an extent necessary for creation of a fold on the web section. No ink offset is to occur between the contacting surfaces of the image area as a result of such web section engagement between the fixed and movable jaws.

No ink offset will occur, either, when the folding blade is withdrawn from between the partial folds of the web section, behaving as aforesaid as if prying open the fixed and movable jaws. The withdrawing folding blade will rub hard against the web section in its pair of opposite margins only, or together with some adjoining parts of the image area. The image area of the web section will not be rubbed so hard as to give rise to ink transfer between its contacting surfaces.

Preferably, or as the need arises, projecting pins or like spike means may be provided on those parts of at least either of the fixed and the movable jaw which are to engage the pair of margins of each web section. The web section will then be captured even more positively between the jaws without in any way aggravating the risk of ink offset between its contacting surfaces.

In the practice of the invention the fixed jaw may take the form of a series of spaced-apart fixed jaw parts, and the movable jaw a series of spaced-apart movable jaw parts, the latter being jointly movable toward and away from the respective fixed jaw parts. Out of the series of fixed jaw parts, the two outmost ones (i.e. those at the opposite extreme ends of the series) are to engage at least the pair of margins of each web section, whereas the other, medially situated ones are to engage the image area of each web section. Likewise, the two outmost ones of the series of movable jaw parts are to engage the pair of margins of each web section, and the medial movable jaw parts are to engage the image area of the web section. A less spacing is therefore provided between the outmost fixed jaw parts and the outmost movable jaw parts than between the medial fixed jaw parts and the medial movable jaw parts.

The provision of the different spacings between the outmost fixed and movable jaw parts and between the medial fixed and movable jaw parts is attainable in various ways. In a preferred embodiment the movable jaw parts are fixedly mounted one to each of a plurality of jaw bases which in turn are mounted to a jaw carrier shaft for bidirectional rotation therewith. The fixed jaw parts are all aligned, and the medial movable jaw parts are positioned farther away from the fixed jaw parts than are the outmost movable jaw parts, by mounting the medial movable jaw parts to the jaw bases via spacers. Use of the spacers between the medial movable jaw parts and their jaw bases is preferred because then the jaw bases for all the movable jaws, both outmost and medial, can be of the same construction.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENT

Figure 1:
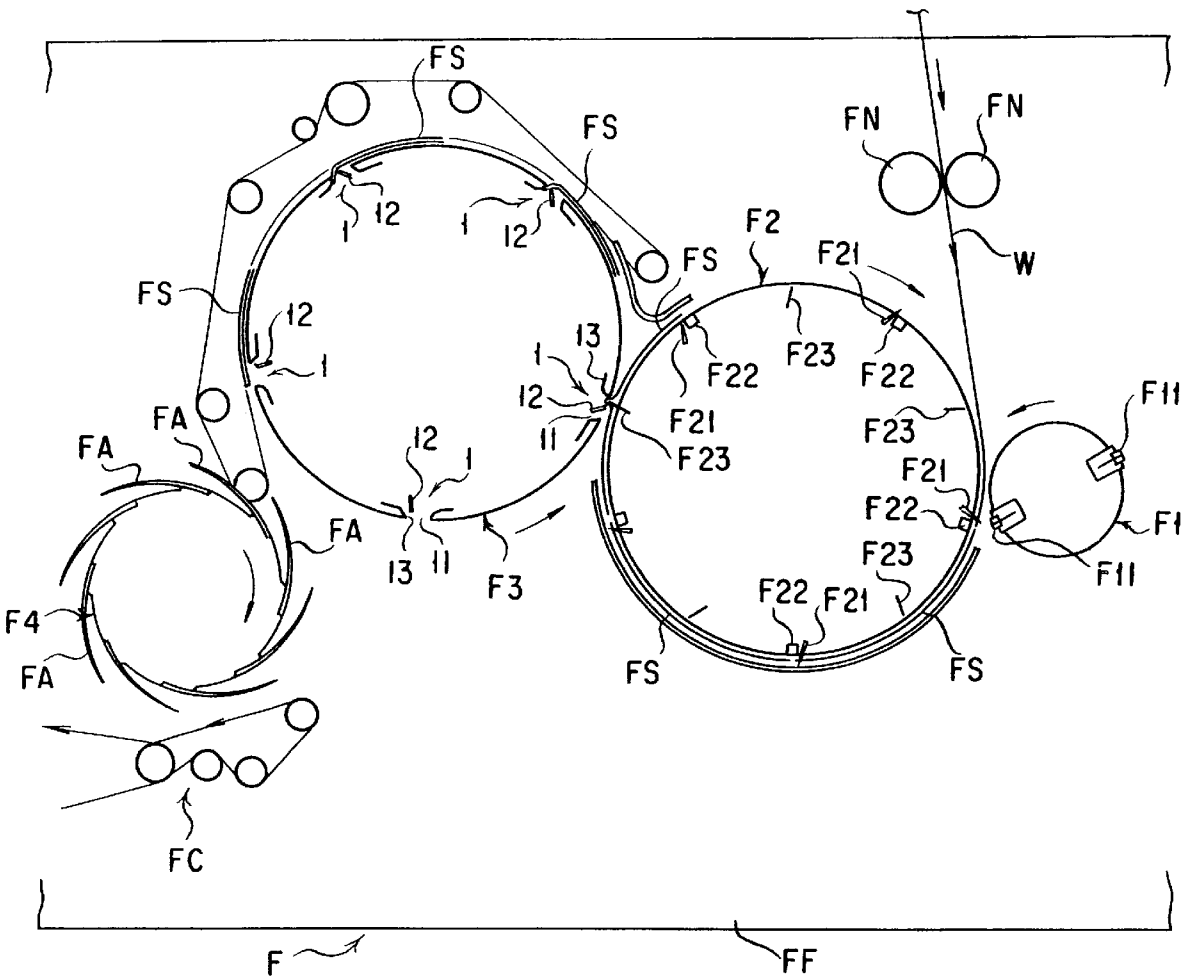
FIG. 1 is a diagrammatic illustration, showing the cylinders in end view, of the folding station of a web-fed printing press to which the present invention is applicable.

The present invention is best applicable to the folding station of a rotary printing press constructed as illustrated in FIG. 1. At FN in this figure are shown a pair of feed rollers for frictionally introducing a printed paper web W into the folding station F. This folding station has a cutter cylinder $F_1$, a folding cylinder $F_2$, a jaw cylinder $F_3$, and a delivery fan $F_4$, all rotatably mounted between a pair of confronting framing walls FF, one shown. A delivery conveyor FC underlies the delivery fan $F_4$.

The cutter cylinder $F_1$ has one or more, two shown, cutting blades $F_{11}$ in circumferentially spaced-apart positions, with each blade extending parallel to the cutter cylinder axis. The folding cylinder $F_2$ has a plurality of, five in this embodiment, anvils or beds $F_{22}$ at constant circumferential spacings on its surface for mating engagement with the cutting blades $F_{11}$ on the cutter cylinder $F_1$. Also mounted to the surface of the folding cylinder $F_2$ are rows of piercing pins $F_{21}$ positioned immediately upstream of the anvils $F_{22}$ with respect to the arrow-marked direction of rotation of the folding cylinder.

Wrapped around part of the folding cylinder $F_2$, the web W will be engaged by the successive rows of piercing pins $F_{21}$ and cut transversely into sections FS as the two cutting blades $F_{11}$ on the cutter cylinder $F_1$ alternately engage in the successive anvils $F_{22}$ on the folding cylinder $F_2$. The web sections FS will then ride on the folding cylinder $F_2$ with their leading edges held engaged by the piercing pins $F_{21}$.

The jaw cylinder $F_3$, which is shown to be of the same diameter as the folding cylinder $F_2$, has defined in its surface a plurality, five in this embodiment, jaw cavities 11 at constant circumferential spacings. Carried by the folding cylinder $F_2$ to a position opposite one of the jaw cavities 11 in the jaw cylinder $F_3$, each web section FS will have its leading edge released from the piercing pins $F_{21}$ as the latter then retract into the folding cylinder $F_2$. Concurrently, the web section FS will have its midpart pushed by one of folding blade $F_{23}$ on the folding cylinder $F_2$ off its surface into one of the jaw cavities 11 in the jaw cylinder $F_3$. The inserted midpart of the web section FS is therein to be engaged by a movable jaw 12 against a fixed jaw 13. The folding blade $F_{23}$ will be subsequently withdrawn from between the creasing jaws 12 and 13, leaving the web section FS captured therebetween in order to be folded. As the folding cylinder $F_2$ and jaw cylinder $F_3$ continue rotation in opposite directions, the web section FS will ride from folding cylinder onto jaw cylinder and, by so doing, be folded along the centerline.

Positioned between jaw cylinder $F_3$ and delivery conveyor FC, the delivery fan $F_4$ has a plurality of vanes FA mounted slantingly on its surface to define pockets. The folded web sections or signatures FS are to drop successively by gravity from the jaw cylinder $F_3$ into these pockets on the delivery fan $F_4$ and thence onto the delivery conveyor FC.

The construction of the folding station F as so far described is conventional, and therein lies no feature of the instant invention. The novel features of the invention will appear in the course of the following detailed description of the jaw cylinder $F_3$, which is shown in more detail in FIGS. 2–6.

Figure 2:
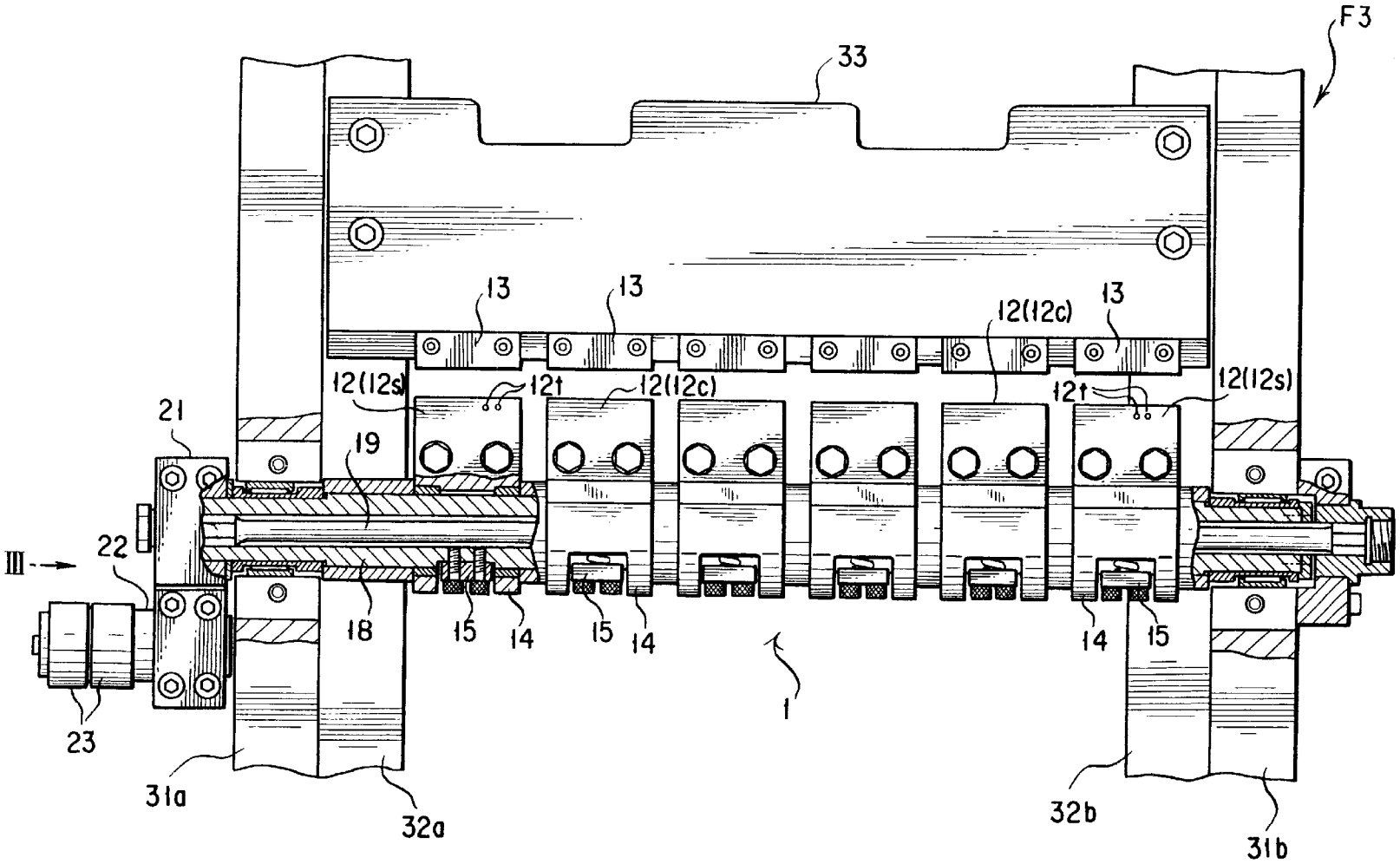
FIG. 2 is an enlarged, fragmentary developed view, with parts shown broken away for clarity, of the jaw cylinder at the folding station shown in FIG. 1.
Figure 3:
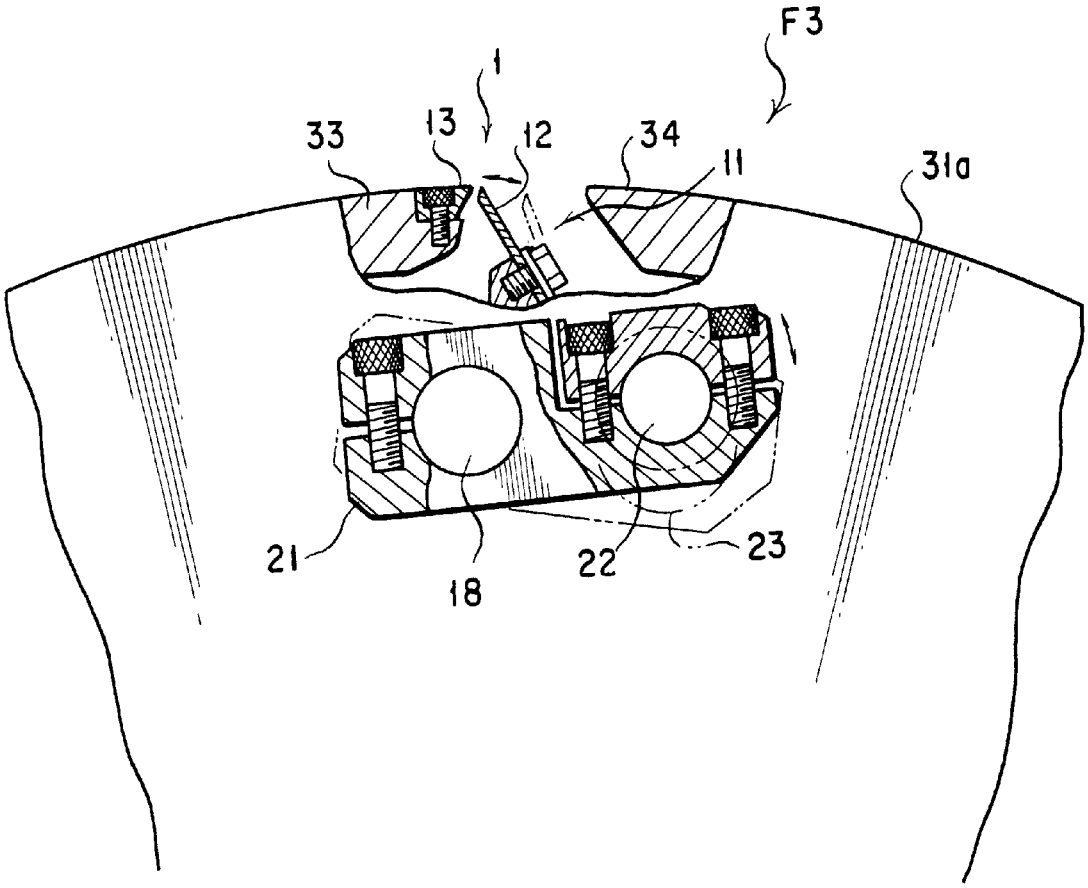
FIG. 3 is a fragmentary end view, with parts shown broken away or to reveal other parts, of the jaw cylinder as seen in the direction of the arrow III in FIG. 2.

With reference first to FIGS. 2 and 3 the jaw cylinder $F_3$ is constituted of a pair of outer end discs $\mathbf{31}_a$ and $\mathbf{31}_b$, a pair of inner end discs $\mathbf{32}_a$ and $\mathbf{32}_b$, and a plurality of ties 33 and 34 each having its opposite ends fastened to either of the two pairs of end disks. Each neighboring pair of ties 33 and 34 are spaced from each other to define one of the five jaw cavities 11 which have been set forth in connection with FIG. 1. Mounted in each jaw cavity 11 are a series of fixed jaw parts 13, shown also in FIG. 4, which are screwed or otherwise affixed to the edge of the tie 33 bounding the upstream edge of the jaw cavity with respect to the predetermined rotational direction of the jaw cylinder $F_3$. Each series of fixed jaw parts will be hereinafter collectively referred to as fixed jaw, and individually as fixed jaw parts, with use of the same reference numeral 13 in both cases.

In each jaw cavity 11 a jaw carrier shaft 18 is rotatably supported by having its opposite ends journaled in the pair of end discs $\mathbf{31}_a$ and $\mathbf{31}_b$. The jaw carrier shaft 18 has a torsion-bar spring 19 built into it and thereby biased to turn clockwise as viewed in FIG. 3. A series of movable jaw parts 12 are mounted to this jaw carrier shaft 18 via movable jaw bases 14 for pivotal motion toward and way from the respective fixed jaw parts 13. Each series of movable jaw parts will also be hereinafter collectively referred to as movable jaw, individually as movable jaw parts, and the same reference numeral 12 will be used in both cases. Further, as will be understood from FIGS. 2 and 3, the two outmost ones of each series of movable jaw parts 12 are identified by parenthesized $\mathbf{12}_s$, and the other, medial jaw parts by parenthesized $\mathbf{12}_c$.

With continued reference to FIGS. 2 and 3 one end of the jaw carrier shaft 18, projecting outwardly of the outer end disk $\mathbf{31}_a$, has a crank arm 21 mounted fast thereto. The crank arm 21 has a crankpin 23 on which are rotatably mounted a pair of cam follower rollers 23 for rolling engagement in a jaw drive cam, not shown, which is mounted to one of the confronting framing walls FF, FIG. 1. With the rotation of the jaw cylinder $F_3$ the cam follower rollers 23 are to roll along the groove delineated by the jaw drive cam, causing the crank arm 21 to turn bidirectionally between the solid-line and phantom positions of FIG. 3. The bidirectional turn of the crank arm 21 is imparted directly to the jaw carrier shaft 18.

Figure 5:
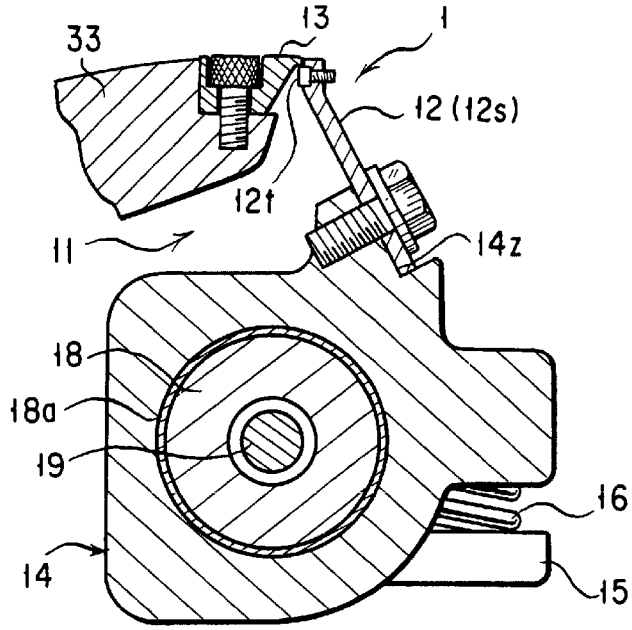
FIG. 5 is a section taken along the line V—V in FIG. 4 and showing in particular one of the outmost fixed jaw parts and one of the outmost movable jaw parts, together with the jaw base for the outmost movable jaw part.
Figure 6:
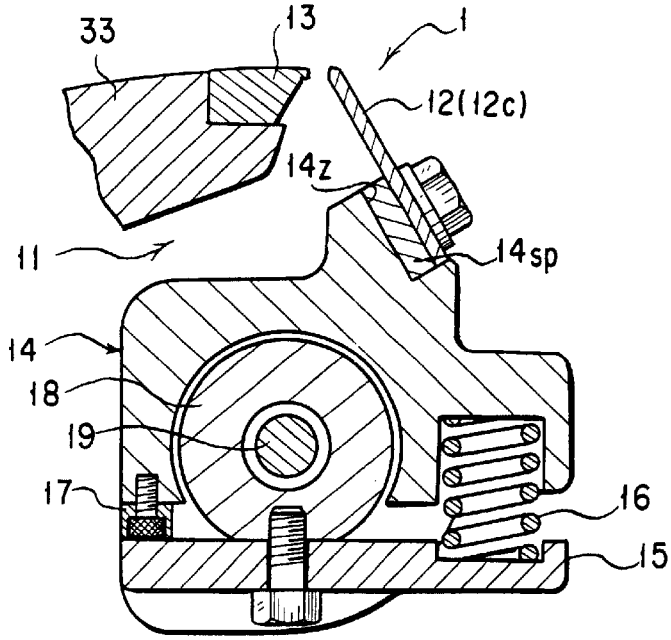
FIG. 6 is a section taken along the line VI—VI in FIG. 4 and showing in particular one of the medial fixed jaw parts and one of the medial movable jaw parts, together with the jaw base for the medial movable jaw part.

A consideration of FIGS. 5 and 6 taken together with FIG. 2 will reveal that each movable jaw base 14 is rotatably mounted on the jaw carrier shaft 18 via a pair of sleeve bearings $\mathbf{18}_a$. The movable jaw base 14 is centrally apertured to expose part of the jaw carrier shaft 18. A spring seat 15 is fastened or otherwise secured to the thus exposed part of the jaw carrier shaft 18 for joint rotation therewith, and a helical compression spring 16 is mounted between jaw base 14 and spring seat 15 on one side of the jaw carrier shaft 18. On the other side of the jaw carrier shaft 18, the jaw base 14 is biased by the compression spring 16 into abutment against the spring seat 15 via a member 17 of wear-resistant material. The rotation of the jaw carrier shaft 18 in a counterclockwise direction, as viewed in FIG. 6, in opposition to the force of the torsion-bar spring 19 is therefore imparted to the jaw base 14 via the spring seat 15 and compression spring 16, causing the associated movable jaw part 12 to move toward the fixed jaw part 13. Upon clockwise rotation of the jaw carrier shaft 18, on the other hand, the spring seat 15 will act directly and rigidly upon the jaw base 14 to cause retraction of the movable jaw part 12 away from the fixed jaw part 13.

FIGS. 5 and 6 are additionally illustrative of how the outmost movable jaw parts $\mathbf{12}_s$ and medial movable jaw parts $\mathbf{12}_c$ are mounted to the jaw bases 14. The jaw bases 14 for both outmost and medial movable jaw parts $\mathbf{12}_s$ and $\mathbf{12}_c$ are of the same construction, identical in both shape and size. However, the two outmost movable jaw parts $\mathbf{12}_s$ are each fastened directly to the base seat $\mathbf{14}_z$ of the jaw base 14 as in FIG. 5 whereas the four medial movable jaw parts $\mathbf{12}_c$ are each fastened to the jaw base seat via a spacer $\mathbf{14}_{sp}$.

Figure 4:
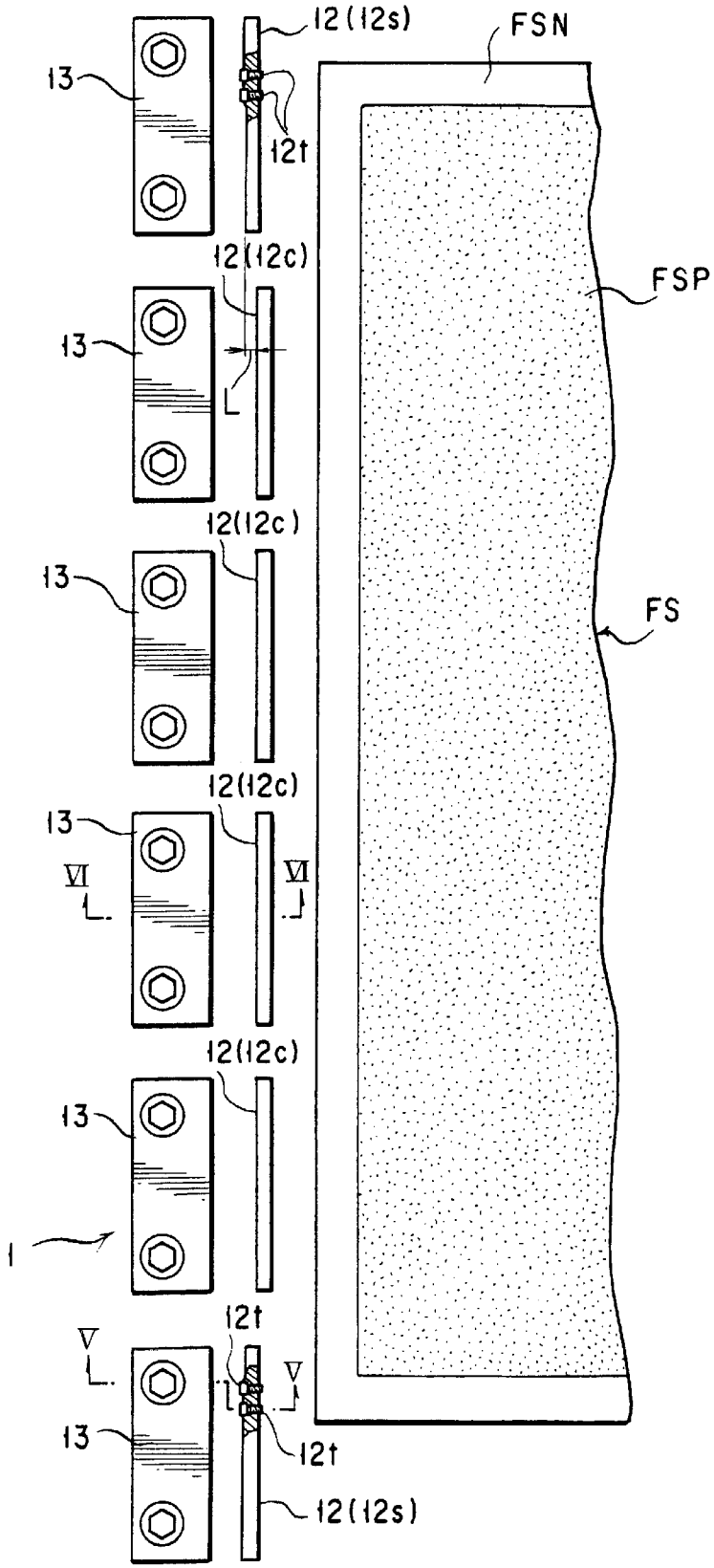
FIG. 4 is an illustration, in their relative positions, of a series of fixed jaw parts and a series of movable jaw parts provided in each jaw cavity of the jaw cylinder, the fixed and the movable jaw parts being shown together with a web section to be folded thereby.

Consequently, as depicted in FIG. 4, the outmost movable jaw parts $\mathbf{12}_s$ are normally positioned closer to the fixed jaw 13 by a distance L than are the medial movable jaws $\mathbf{12}_c$. The outmost movable jaw parts $\mathbf{12}_s$ are therefore to press the web section FS harder against the fixed jaw 13 than do the medial movable jaws 12. When the movable jaw 12 is fully turned toward the fixed jaw 13, the compression springs 16 will be compressed to variable degrees depending upon the thickness of the folded midpart of the web section FS caught therebetween. The variable degrees of compression of the compression springs 16 determine variable amounts of energy acting on the respective movable jaw parts 12 to cause the same to press the web section FS against the fixed jaw 13.

Although the placement of the outmost movable jaw parts $\mathbf{12}_s$ closer to the fixed jaw 13 than that of the medial movable jaw parts $\mathbf{12}_c$ is an essential feature of this embodiment of the invention, the mounting of the medial movable jaw parts to the jaw bases 14 via the spacers $\mathbf{14}_{sp}$ is not. The desired objective would be attained if the jaw bases 14 for the medial movable jaw parts $\mathbf{12}_c$ were constructed in one piece with the spacers $\mathbf{14}_{sp}$. The use of the spacers is preferred because they permit use of jaw bases of the same construction, identical in both shape and size, for both outmost and medial movable jaw parts $\mathbf{12}_s$ and $\mathbf{12}_c$.

It will also be observed from FIG. 4, or from a comparison of FIGS. 5 and 6, that the outmost movable jaw parts $\mathbf{12}_s$ are thicker than the medial movable jaw parts $\mathbf{12}_c$. As depicted also in FIG. 2, the thicker outmost movable jaw parts $\mathbf{12}_s$ have spikes $\mathbf{12}_t$ projecting therefrom toward the fixed jaw 13 for engaging the pair of margins FSN on both sides of the image area FSP of each web section FS. The spikes $\mathbf{12}_t$ are shown as the heads of machine screws by way of example only, all that is required being that there be projections or protuberances on the outmost movable jaw parts $\mathbf{12}_s$ that are capable of frictional engagement with the web sections FS without impairing them. Such projections may take a variety of shapes such as, for instance, a semicylinder laid parallel to the jaw cylinder axis. Wear resistance is another important property of the spikes $\mathbf{12}_t$ for the desired longer useful life of the jaw cylinder with a minimum of maintenancing. The spikes $\mathbf{12}_t$ may be rendered wear resistant as by heat treatment or by the coverings of titanium or tungsten carbide.

Operation

The web of paper W is to be threaded through the folding station F as indicated in FIG. 1. As the printing press is set into operation, the cutter cylinder $F_1$, folding cylinder $F_2$, jaw cylinder $F_3$ and delivery fan $F_4$ will all rotate at the same peripheral speed. Traveling over the folding cylinder $F_2$, the printed web W will be cut into successive sections FS by the sawtoothed cutting blades $F_{11}$ on the cutter cylinder $F_1$ in cooperation with the anvils $F_{22}$ on the folding cylinder.

In a position angularly spaced approximately three fifths of a complete revolution of the folding cylinder $F_2$ from where the web W is cut as above, each web section FS will have its midpart placed opposite one of the jaw cavities 11 in the jaw cylinder $F_3$. One of the folding blades $F_{23}$ on the folding cylinder $F_2$ will then push this midpart of the web section FS into the jaw cavity 11. Thereupon the movable jaw 12 mounted in this jaw cavity will turn from the phantom position of FIG. 3 to that indicated by the solid lines, engaging the inserted midpart of the web section FS against the fixed jaw 13 together with the folding blade $F_{23}$. The movable jaw 12 will be so actuated as the crank arm 21 on the jaw carrier shaft 18 is caused to turn counterclockwise in FIG. 3 by the unshown jaw drive cam with which the cam follower rollers 23 on the crankpin 22 travel in constant engagement during the rotation of the jaw cylinder $F_3$. The jaw carrier shaft 18 will turn with the crank arm 21 against the force of the torsion-bar spring 19 built into it.

As will be understood by referring to FIGS. 5 and 6 again, the counterclockwise rotation of the jaw carrier shaft 18 will be imparted to the movable jaw parts 12 via the spring seats 15, compression springs 16 and jaw bases 14. The movable jaw parts 12 will thus resiliently press the midpart of the web section FS against the fixed jaw 13 as the compression springs 16 undergo depression to variable degrees determined by the total thickness of the doubled midpart of the web section FS and the folding blade $F_{23}$, the latter being still caught in the former.

With the continued rotation of the folding cylinder $F_2$ and jaw cylinder $F_3$, the folding blade $F_{23}$ will withdraw out of the jaw cavity 11 in the jaw cylinder and retract into the folding cylinder, leaving behind the doubled midpart of the web section FS. Then the movable jaw 12 will be urged by the compression springs 16 to press the midpart of the web section FS against the fixed jaw 13 and hence to fold the same along its centerline. The force exerted at this time by each movable jaw part 12 on the web section FS is proportional to the extent to which the associated compression spring 16 has been compressed when that movable jaw part is turned toward the fixed jaw 13. As a result, assuming that the web section FS is of constant thickness throughout its dimension parallel to the jaw cavity 11, the two outmost movable jaw parts $\mathbf{12}_s$ will be sprung more heavily toward the fixed jaw 13 than are the four medial movable jaw parts $\mathbf{12}_c$. The spikes $\mathbf{12}_t$ on these outmost movable jaw parts $\mathbf{12}_s$, in particular, will be most strongly urged toward the fixed jaw 13.

The foregoing will have made it clear that the web section FS has its pair of opposite margins FSN gripped hard enough to defeat the risk of accidental disengagement, whereas its image area FSP is caught only to an extent necessary for folding. No such pressure will act on the image area FSP as to bring about ink offset between the contacting surfaces of the web section. It is of course desirable that the web section FS be gripped hard only in its margins FSN. In practice, however, these margins are variable in width. Some neighboring parts of the image area FSP may therefore be pressed hard in some cases, with consequent ink transfer at such parts of the image area. This will bring about no serious degradation of the printing quality because the printings will be smeared in so narrowly confined, marginal areas only.

The printings will not be smeared, either, by the folding blades $F_{23}$ on the folding cylinder $F_2$ during their withdrawal from between the folds of the web sections FS. The folding blade $F_{23}$ will then rub relatively hard only against the margins FSN, and possibly some neighboring parts of the image area FSP, of the web section FS. All or most part of the image area FSP will not be rubbed so strongly as to result in ink offset.

The successive web sections FS on the folding cylinder $F_2$ will be thrust into the jaw cavities 11 in the jaw cylinder $F_3$ and gripped by the sets of jaws 12 and 13 with every one fifth of a revolution of the folding cylinder $F_2$ and jaw cylinder $F_3$. Gripped by one set of jaws 12 and 13, each web section FS will come off the folding cylinder $F_2$ and completely folded on the jaw cylinder $F_3$ by another one fifth of a revolution of these cylinders $F_2$ and $F_3$.

Each web section FS will ride over the jaw cylinder $F_3$ approximately three fifths of a revolution. Then the crank arm 21 on the jaw carrier shaft 18 will turn clockwise, as viewed in FIG. 3, under the influence of the unshown jaw drive cam with which the cam follower rollers 23, FIG. 2, are traveling in constant engagement during the rotation of the jaw cylinder $F_3$. The torsion-bar spring 19 will assist such clockwise turn of the jaw carrier shaft 18. Turning clockwise with the jaw carrier shaft 18, the movable jaw 12 will release the folded web section FS and so allow the same to fall by gravity off the surface of the jaw cylinder $F_3$ into one of the pockets defined by the slanting vanes FA, FIG. 1, on the delivery fan $F_4$. This delivery fan is in constant rotation in a clockwise direction as viewed in FIG. 1. The vanes FA are so angled with respect to this rotational direction of the delivery fan $F_4$ that the folded web section FS will subsequently slide down the vane onto the underlying delivery conveyor FC thereby to be transported to a place of shipment.

Conclusion

Notwithstanding the foregoing detailed disclosure it is not desired that the present invention be limited by the exact showing of the appended drawings or by the description thereof. The invention proposes, in its broader aspect, that there should be a greater spacing between those parts of the fixed and movable jaws which engage the image area of the web sections than between the other parts of the jaws which are to engage the margins only, or together with some neighboring image area parts, of the web sections. This objective is achieved in the illustrated embodiment by placing the four medial movable jaw parts $\mathbf{12}_c$ farther away from the fixed jaw 13 than are the two outmost movable jaw parts $\mathbf{12}_s$. The same objective is attainable in some other ways, however.

For example, all the movable jaw parts 12 may be aligned, and the four medial fixed jaw parts 13 may be positioned farther away from the movable jaw parts than are the other two outmost fixed jaw parts. As an additional alternative, the medial movable jaw parts and the medial fixed jaw parts may both be positioned rearward of the outmost movable jaw parts and the outmost fixed jaw parts, respectively. Either of these alternative jaw arrangements will offer the same advantageous effects as those gained by the illustrated embodiment.

Similarly, the spikes $\mathbf{12}_t$ may not necessarily be provided on the two outmost movable jaw parts alone, but on the two outmost fixed jaw parts, or on both outmost movable jaw parts and outmost fixed jaw parts. The spikes will perform the same desired functions in either case.

It is also apparent that the configuration of the folding station illustrated in FIG. 1 is not intended to impose limitations upon the invention. The jaw cylinder constructed on the novel concepts of this invention will lend itself to use in folding stations of a variety of other known or suitable designs. All these modifications, alterations and adaptations of the illustrated embodiment may be resorted to in a manner limited only by a just interpretation of the claims which follow.

What is claimed is:

1. In a folding station of a web-fed printing press where a printed paper web is cut into sections by a cutter cylinder while traveling on a folding cylinder, each web section having a pair of margins on opposite sides of an image area, a jaw cylinder for folding each web section into the form of a signature in cooperation with the folding cylinder, the jaw cylinder comprising:

(a) means including a fixed jaw and defining in the jaw cylinder a jaw cavity extending parallel to the axis of the jaw cylinder; and (b) a movable jaw mounted in the jaw cavity for movement toward and away from the fixed jaw in order to engage and fold each web section as its midpart is inserted in the jaw cavity by a folding blade on the folding cylinder;

(c) there being a less spacing between those parts of the fixed and the movable jaw which are to engage the pair of margins of each web section than between those parts of the fixed and the movable jaw which are to engage the image area of each web section.

2. The jaw cylinder of claim 1 further comprising spike means formed on those parts of at least either of the fixed and the movable jaw which are to engage the pair of margins of each web section.

3. In a folding station of a web-fed printing press where a printed paper web is cut into sections by a cutter cylinder while traveling on a folding cylinder, each web section having a pair of margins on opposite sides of an image area, a jaw cylinder for folding each web section into the form of a signature in cooperation with the folding cylinder, the jaw cylinder comprising:

(a) means including a series of fixed jaw parts and defining in the jaw cylinder a jaw cavity extending parallel to the axis of the jaw cylinder, the series of fixed jaw parts being comprised of two outmost fixed jaw parts which are to engage at least the pair of margins of each web section, and of medial fixed jaw parts which are to engage the image area of each web section; and (b) a series of movable jaw parts mounted in the jaw cavity for movement toward and away from the respective fixed jaw parts in order to engage and fold each web section as its midpart is inserted in the jaw cavity by a folding blade on the folding cylinder, the series of movable jaw parts being comprised of two outmost movable jaw parts which are to engage at least the pair of margins of each web section, and of medial movable jaw parts which are to engage the image area of each web section;

(c) there being a less spacing between the outmost fixed jaw parts and the outmost movable jaw parts than between the medial fixed jaw parts and the medial movable jaw parts.

4. The jaw cylinder of claim 3 further comprising spike means formed on outmost ones of at least either of the fixed and the movable jaw parts for more positively engaging the pair of margins of each web section.

5. The jaw cylinder of claim 4 wherein the outmost movable jaw parts are thicker than the medial movable jaw parts and have the spike means mounted thereto.

6. In a folding station of a web-fed printing press where a printed paper web is cut into sections by a cutter cylinder while traveling on a folding cylinder, each web section having a pair of margins on opposite sides of an image area, a jaw cylinder for folding each web section into the form of a signature in cooperation with the folding cylinder, the jaw cylinder comprising:

(a) means including a series of fixed jaw parts and defining in the jaw cylinder a jaw cavity extending parallel to the axis of the jaw cylinder, the series of fixed jaw parts being comprised of two outmost fixed jaw parts which are to engage at least the pair of margins of each web section, and of medial fixed jaw parts which are to engage the image area of each web section;

(b) a jaw carrier shaft rotatably mounted in the jaw cavity and extending parallel to the axis of the jaw cylinder;

(c) a plurality of jaw bases mounted to the jaw carrier shaft for bidirectional rotation therewith; and (d) a series of movable jaw parts fixedly mounted one to each jaw base for pivotal movement toward and away from the respective fixed jaw parts in order to engage and fold each web section as its midpart is inserted in the jaw cavity by a folding blade on the folding cylinder, the series of movable jaw parts being comprised of two outmost movable jaw parts which are to engage at least the pair of margins of each web section, and of medial movable jaw parts which are to engage the image area of each web section;

(e) the outmost movable jaw parts being positioned closer to the outmost fixed jaw parts than the medial movable jaw parts are to the medial fixed jaw parts, the outmost fixed jaw parts and medial fixed jaw parts being all in alignment;

(f) whereby each web section has its pair of margins engaged more firmly between the outmost fixed jaw parts and the outmost movable jaw parts than its image area is between the medial fixed jaw parts and the medial movable jaw parts, in order to avoid ink offset between contacting surfaces of the web section.

7. The jaw cylinder of claim 6 wherein the jaw bases are all of the same construction, and wherein the jaw cylinder further comprises spacers through which the medial movable jaw parts are mounted to the jaw bases in order to be positioned farther away from the fixed jaw parts than the outmost movable jaw parts are.

8. The jaw cylinder of claim 6 further comprising spike means formed on the outmost movable jaw parts for more positively engaging the pair of margins of each web section.

9. The jaw cylinder of claim 6 wherein the outmost movable jaw parts are thicker than the medial movable jaw parts.

* * * * *